US008783146B2

(12) United States Patent
Chacko et al.

(10) Patent No.: US 8,783,146 B2
(45) Date of Patent: Jul. 22, 2014

(54) ABRASIVE WATERJET FOCUSING TUBE RETAINER AND ALIGNMENT

(75) Inventors: Shajan Chacko, Joplin, MO (US); David Wands, Columbus, KS (US)

(73) Assignee: KMT Waterjet Systems Inc., Baxter Springs, KS (US)

( * ) Notice: Subject to any disclaimer, the term of this patent is extended or adjusted under 35 U.S.C. 154(b) by 298 days.

(21) Appl. No.: 13/289,756

(22) Filed: Nov. 4, 2011

(65) Prior Publication Data

US 2013/0112056 A1 May 9, 2013

(51) Int. Cl.
*B26F 3/00* (2006.01)
*B05B 15/08* (2006.01)
*B24B 1/00* (2006.01)

(52) U.S. Cl.
USPC ..... 83/177; 239/587.1; 451/38

(58) Field of Classification Search
USPC ..... 83/177, 53, 701; 239/433, 587.1, 587.4, 239/589, 600, DIG. 8; 451/38, 75, 102
See application file for complete search history.

(56) References Cited

U.S. PATENT DOCUMENTS 3,604,632 A * 9/1971 Eichelman ..... 239/419.3
4,505,221 A 3/1985 Falckenberg et al.
4,545,157 A * 10/1985 Saurwein ..... 451/102
4,563,116 A 1/1986 Edens
4,587,772 A * 5/1986 Griffiths ..... 451/102
4,688,459 A 8/1987 Osborn et al.
4,818,157 A 4/1989 Kouvelis
4,825,963 A 5/1989 Ruhle
4,848,671 A * 7/1989 Saurwein ..... 239/587.1
4,872,615 A * 10/1989 Myers ..... 239/587.4
4,919,023 A 4/1990 Bloink
5,018,670 A * 5/1991 Chalmers ..... 239/433
5,076,740 A 12/1991 Petrie
5,092,085 A * 3/1992 Hashish et al. ..... 451/102
5,131,303 A 7/1992 Wilson et al.
5,144,766 A * 9/1992 Hashish et al. ..... 451/102
5,469,768 A * 11/1995 Schumacher ..... 83/177
5,794,858 A * 8/1998 Munoz ..... 239/433
5,851,139 A * 12/1998 Xu ..... 451/102
5,884,546 A 3/1999 Johnson
5,885,039 A 3/1999 Boisvert
6,077,152 A * 6/2000 Warehime ..... 451/75
6,126,524 A * 10/2000 Shepherd ..... 451/75
6,601,783 B2 * 8/2003 Chisum et al. ..... 239/433
6,619,570 B1 * 9/2003 Ericksen et al. ..... 239/532
6,846,221 B2 1/2005 Ulrich et al.
6,875,084 B2 * 4/2005 Hashish et al. ..... 451/38
6,932,285 B1 * 8/2005 Zeng ..... 239/589
7,159,426 B1 1/2007 Ghiran (Continued)

*Primary Examiner* — Ghassem Alie
*Assistant Examiner* — Bharat C Patel
(74) *Attorney, Agent, or Firm* — Michael Best & Friedrich LLP

(57) ABSTRACT

A cutting head for a high pressure water jet cutting assembly includes a body having an inner chamber and an aperture that extends into the inner chamber. A focusing tube is removably insertable within the inner chamber along a longitudinal axis. An engagement member is at least partially disposed within the aperture and movable between a first position and a second position in which a portion of the engagement member is disposed within the inner chamber. A retaining member is engageable with the body and movable with respect to the body to bias the engagement member into engagement with the focusing tube to retain the focusing tube within the inner chamber and to align the focusing tube substantially along the longitudinal axis.

19 Claims, 7 Drawing Sheets

(56) References Cited

U.S. PATENT DOCUMENTS

| | | | | |
|---|---|---|---|---|
| 7,204,181 | B2 | 4/2007 | Goedeking | |
| 7,584,546 | B2 | 9/2009 | Chabot et al. | |
| 7,703,363 | B2 * | 4/2010 | Knaupp et al. | 83/177 |
| 2002/0066345 | A1 | 6/2002 | Shepherd et al. | |
| 2005/0230152 | A1 | 10/2005 | Joslin | |
| 2006/0223422 | A1 | 10/2006 | Dorfman et al. | |
| 2007/0119992 | A1 | 5/2007 | Hashish | |
| 2007/0155289 | A1 | 7/2007 | Miller | |
| 2008/0032610 | A1 | 2/2008 | Chacko et al. | |

* cited by examiner

ABRASIVE WATERJET FOCUSING TUBE RETAINER AND ALIGNMENT

BACKGROUND

The present invention relates to a device for retaining and aligning an abrasive waterjet focusing tube.

Precision cutting for industrial and commercial purposes is often accomplished through the use of a waterjet system that directs a high speed stream of water at a material surface to be cut. Waterjet cutting uses ultra high pressure water, typically over 30,000 psi, produced on-site with special equipment, to produce a high velocity stream of water traveling at speeds in excess of Mach 2. This high velocity stream, often mixed with an abrasive, is capable of slicing through hard materials such as metal and granite with thicknesses of more than a foot. Among other benefits, waterjet cutting eliminates the adverse effects of high temperature zones and material deformation generated during traditional cutting methods.

SUMMARY

In abrasive waterjet cutting, a focusing tube positioned partially within a cutting head of the waterjet system focuses the energy of the high velocity abrasive-laden stream for discharge. Though the cutting head must be constructed to withstand the effects of extreme water pressures and velocities, the focusing tube should be an easily replaceable and alignable element of the cutting head.

In one embodiment of a cutting head for a high pressure water jet cutting assembly, the cutting head includes a body having an inner chamber and an aperture that extends into the inner chamber. A focusing tube is removably insertable within the inner chamber along a longitudinal axis. An engagement member is at least partially disposed within the aperture and movable between a first position and a second position in which a portion of the engagement member is disposed within the inner chamber. A retaining member is engageable with the body and movable with respect to the body to bias the engagement member into engagement with the focusing tube to retain the focusing tube within the inner chamber and to align the focusing tube substantially along the longitudinal axis.

In another embodiment of a cutting head for a high pressure water jet cutting assembly, the cutting head includes a body having a tube portion that extends along an axis. The tube portion defines an inner chamber. The body further includes a first threaded portion and an aperture that extends through the tube portion in a direction substantially normal to the axis. An engagement member is at least partially disposed within the aperture and movable between a first position and a second position in which a portion of the engagement member is disposed within the inner chamber. A focusing tube is removably insertable into the inner chamber. A retaining member has a second threaded portion that threadably engages the first threaded portion. Movement of the retaining member toward the body biases the engagement member into contact with the focusing tube to retain the focusing tube within the inner chamber and to align the focusing tube substantially along the axis.

In one embodiment of an assembly for retaining and aligning a focusing tube within a shaft of a cutting head of a high pressure water jet cutting assembly, the shaft has a shaft wall defining an inner chamber open to receive the focusing tube along a longitudinal axis and an aperture formed through the wall in communication with the inner chamber. The assembly includes an engagement member having a proximal end adjacent the inner chamber upon insertion into the aperture, and a distal end. The engagement member further includes a substantially flat face at the proximal end and a tapered surface at the distal end. A retaining member is couplable with the shaft and includes an internally tapered surface. Coupling the retaining member to the shaft engages the internally tapered surface with the tapered surface of the engagement member to advance the substantially flat face toward the focusing tube to retain the focusing tube within the inner chamber and to align the focusing tube substantially along the longitudinal axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. And as used herein and in the appended claims, the terms "upper", "lower", "top", "bottom", "front", "back", and other directional terms are not intended to require any particular orientation, but are instead used for purposes of description only.

Figure 1:
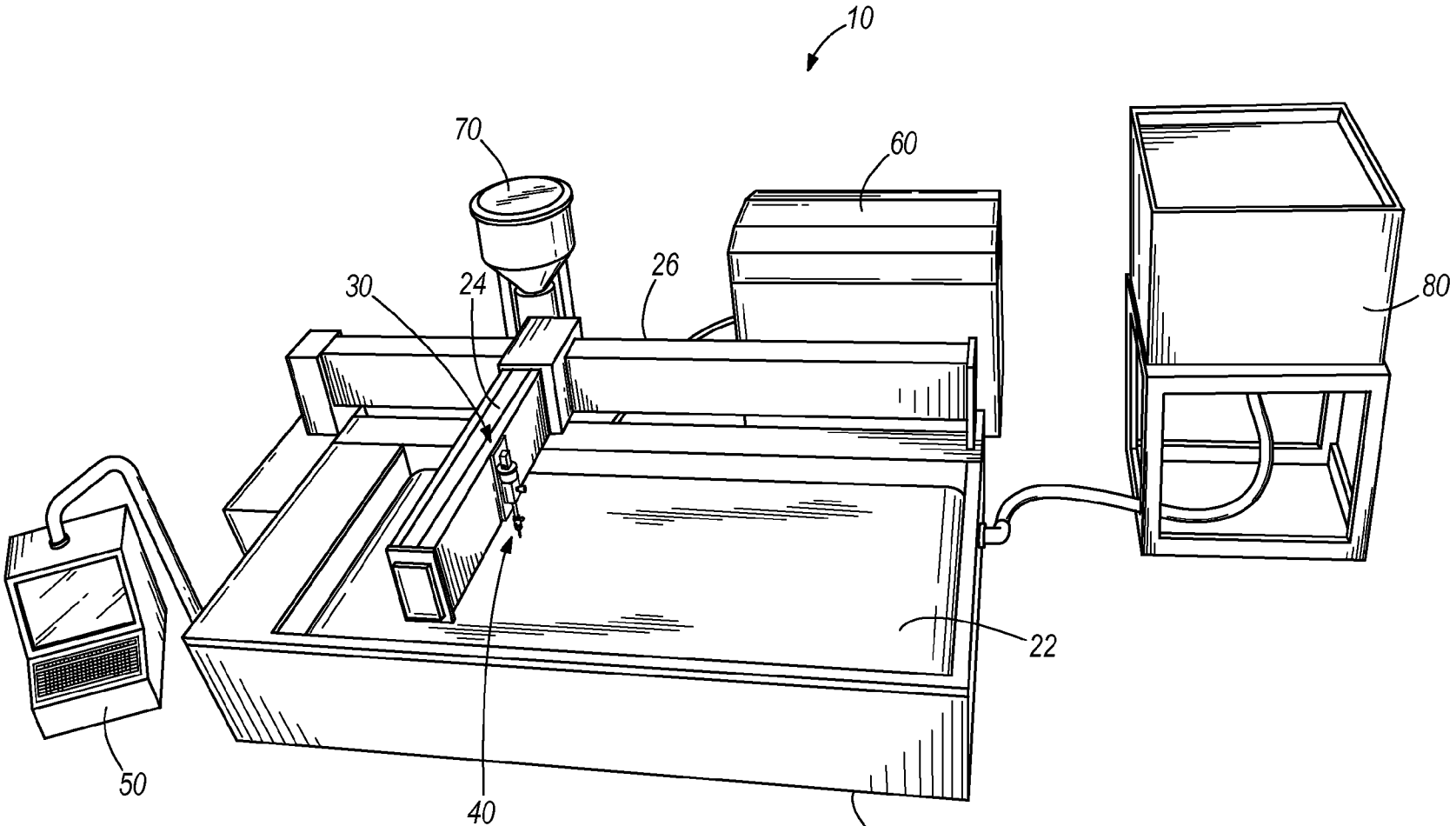
FIG. 1 is a perspective view showing an abrasive waterjet cutting system.

FIG. 1 illustrates an abrasive waterjet cutting system 10 for cutting a particular material with a high pressure stream of water mixed with abrasive. The cutting system 10 includes a cutting table 20 with a material supporting surface 22, and a cutting head assembly 30 that includes a cutting head 40. The cutting head assembly 30 is controlled through a computer 50 and is functionally movable via the arms 24, 26 in a manner known to those of skill in the art to provide cutting at any required operable location on the surface 22. An intensifier pump 60 generates high pressure fluid, typically water, for the cutting process and provides that water through a high pressure tube (not shown) to the cutting head assembly 30. In some constructions, a feed system 70 supplies an abrasive material, such as garnet, that is combined with the water stream at the cutting head 40. An abrasive removal system 80 filters the wastewater produced in the process to recover the abrasive for further use. The wastewater can be disposed of through a drain or recycled to minimize overall water usage.

Figure 2:
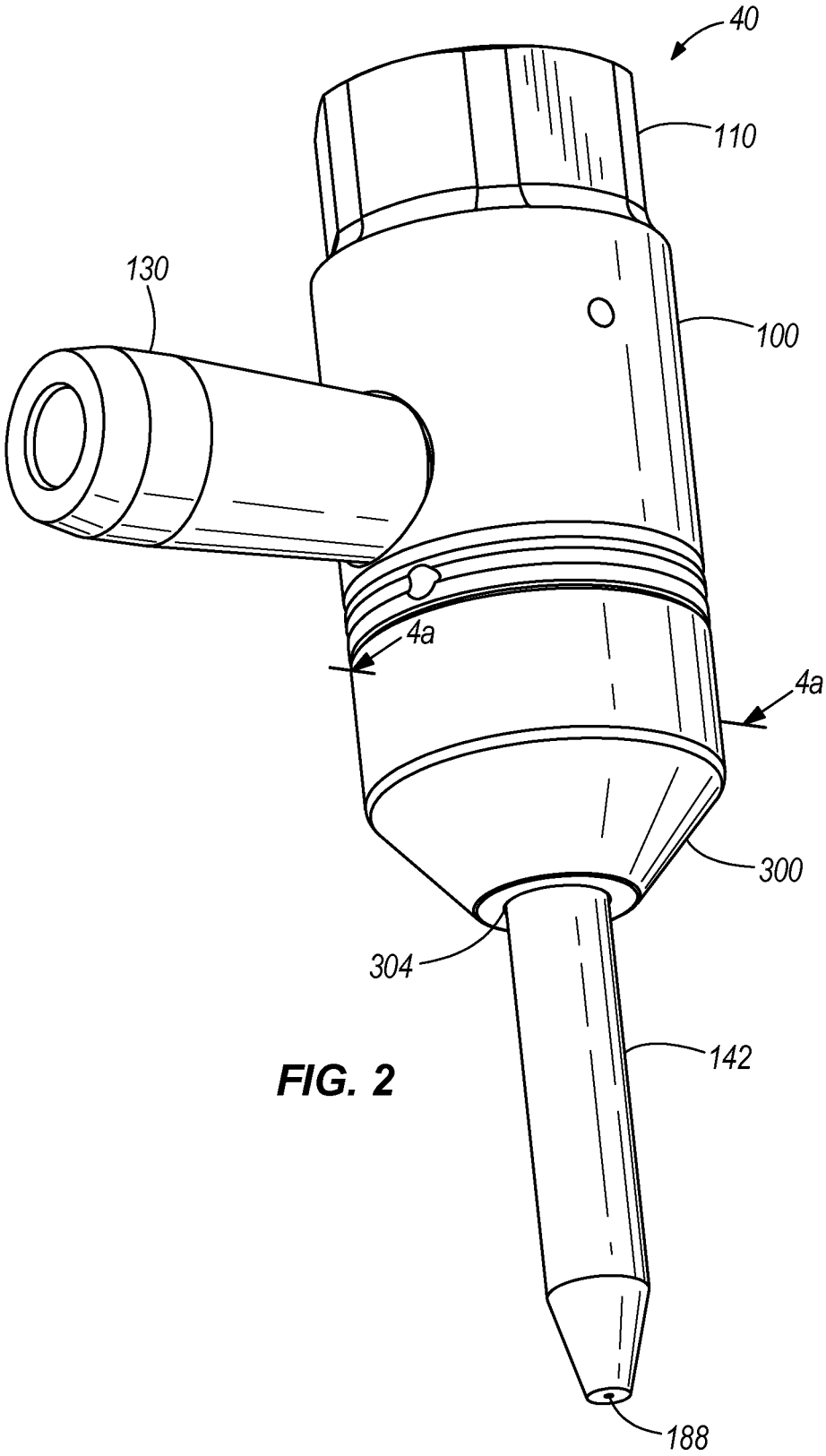
FIG. 2 is a perspective view of a cutting head of the abrasive waterjet cutting system of FIG. 1.
Figure 3:
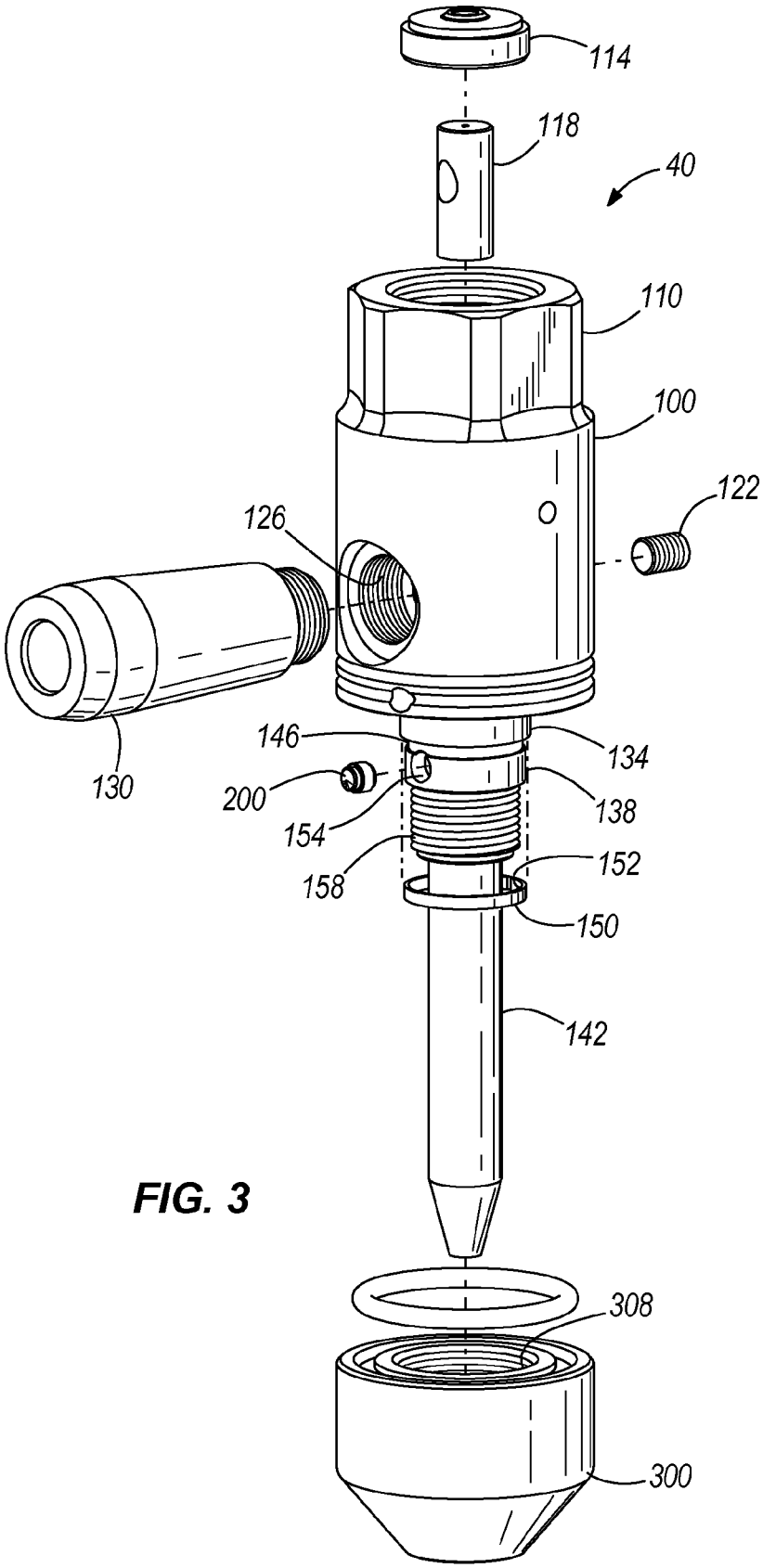
FIG. 3 is an exploded view of the cutting head of FIG. 2.

Referring to FIGS. 2 and 3, the cutting head 40 of the cutting head assembly 30 includes a cutting head body 100 having an integral coupling 110. The coupling 110 is internally threaded and configured for removable attachment to the remainder of the assembly 30. Contained within and concentric to the cutting head body 100 are an orifice mount 114 and a mixing chamber housing 118. The mixing chamber housing 118 is retained within the cutting head body through the use of a set screw 122. A lateral abrasive inlet 126 receives an abrasive port 130 connected to the feed system 70 for the introduction of abrasive into the fluid stream. Extending from the bottom portion of the cutting head body 100 is a shaft 134 generally tubular in shape having a substantially cylindrical wall 138 within which is functionally disposed a removable focusing tube 142. An annular groove 146 formed in the wall 138 seats a hoop ring 150 having an inner retention surface 152. The hoop ring 150 is formed separate from the body and may be shrunk onto the groove 146 or installed in other ways. A generally circular aperture 154 impinges the groove 146 and extends through the wall 138. Male threads 158 are cut into a bottom portion of the shaft 134.

Figure 4A:
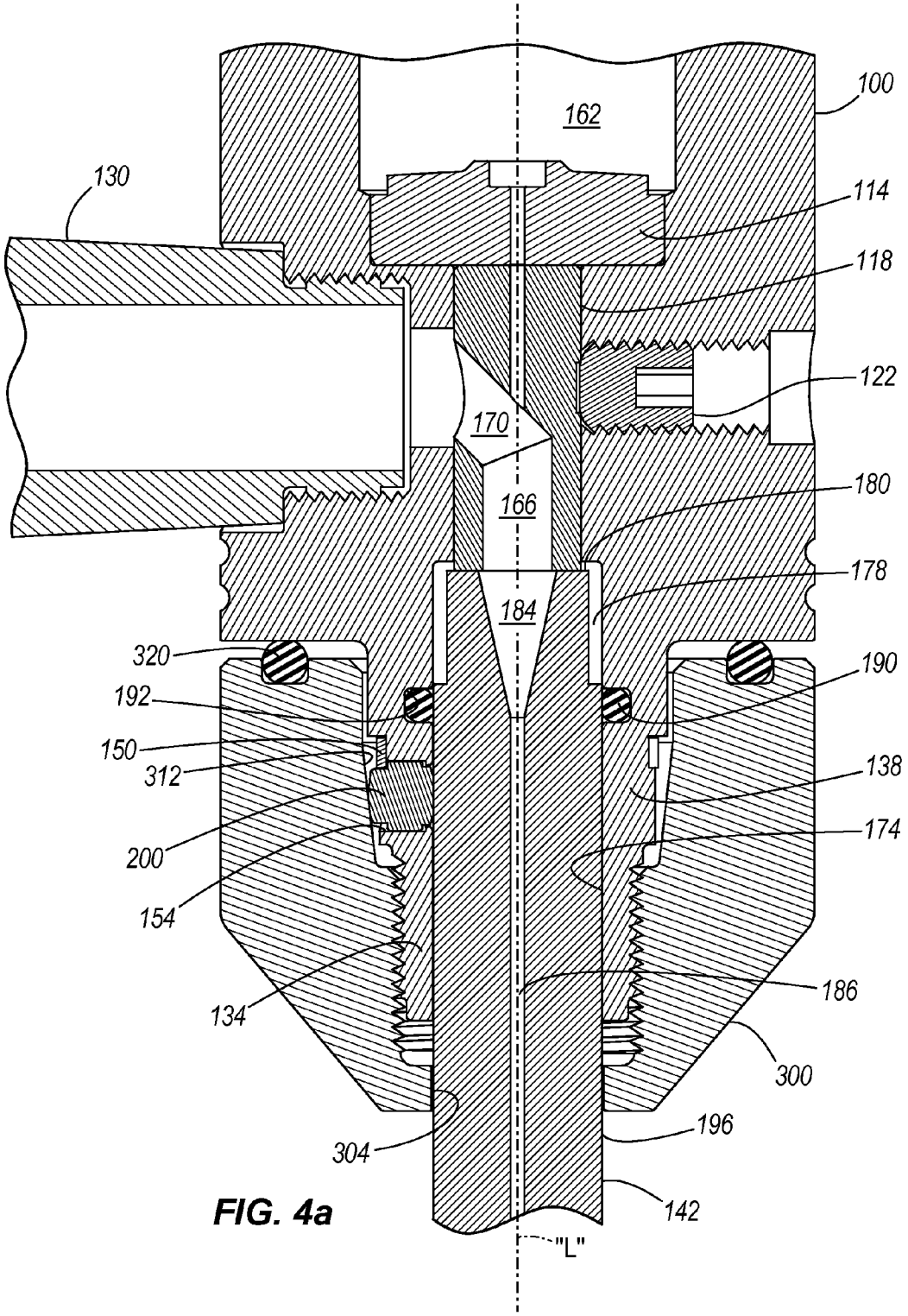
FIG. 4*a* is a section view taken along line 4-4 of FIG. 2 with the retaining nut fully threaded onto the cutting head shaft.
Figure 5:
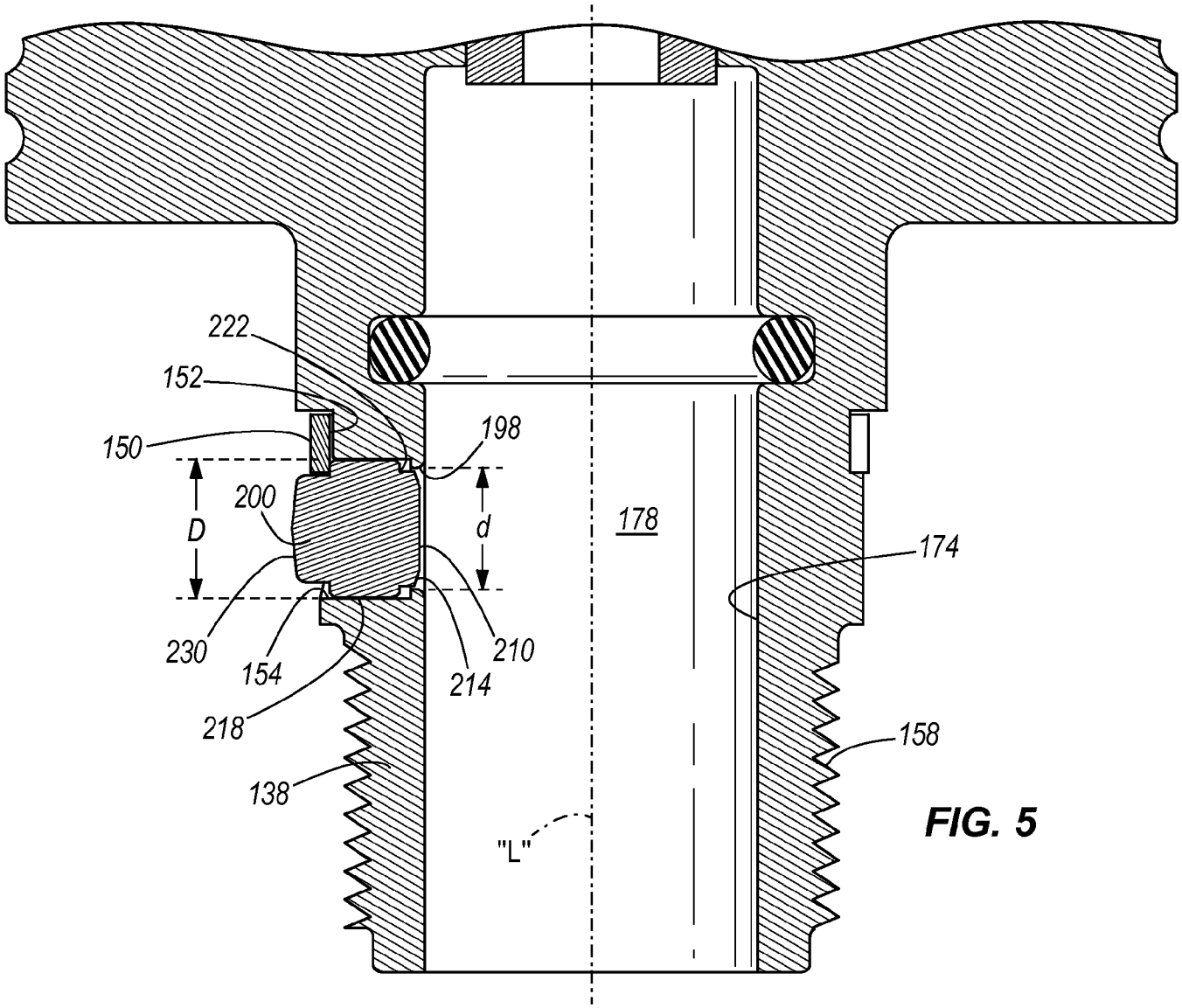
FIG. 5 is a section view showing the retaining pin positioned within the shaft wall aperture.

Referring to FIG. 4*a*, the orifice mount 114 separates a high pressure fluid chamber 162 from the mixing chamber housing 118, which is in fluid communication with the abrasive inlet 126 and abrasive port 130. A mixing chamber 166 within the chamber housing 118 includes an angled abrasive entrance portion 170. The illustrated entrance portion 170 is approximately 45° from the cutting head longitudinal axis "L," but can range from approximately 0° to approximately 90°. The central axes 130, 170 could also be concentric, while keeping the entrance portion 170 at 45 degrees with respect to the longitudinal axis "L". The wall 138 has a substantially cylindrical inner wall surface 174 that defines an inner tube chamber 178 open to receive the focusing tube 142. Full insertion of the focusing tube 142 within the tube chamber 178 creates a contact interface 180 between the tube 142 and the mixing chamber housing 118. A top portion of the focusing tube 142 includes a funnel 184 that leads into a substantially cylindrical bore or stream channel 186 extending through the remaining length of the tube 142 to a discharge opening 188 (see FIG. 2). An o-ring 190 within a groove 192 of the inner wall surface 174 sealingly engages the substantially cylindrical exterior surface 196 of the focusing tube 142 upon insertion into the tube chamber 178. Referring also to FIG. 5, the aperture 154 extends through the wall 138 in a direction substantially normal to the axis "L" and is in fluid communication with the tube chamber 178. A circumferential step 198 integrally formed within the aperture 154 as part of the wall 138 adjoins the inner wall surface 174 and presents an inner diameter "d."

Referring to FIGS. 3 and 4*a*, an engagement member, such as a retaining pin 200 for retaining and aligning the focusing tube 142 is disposed within the aperture 154. In alternative embodiments, a plurality of retaining pins 200 can be positioned in a plurality of apertures 154 spaced apart around the shaft 134.

Figure 6:
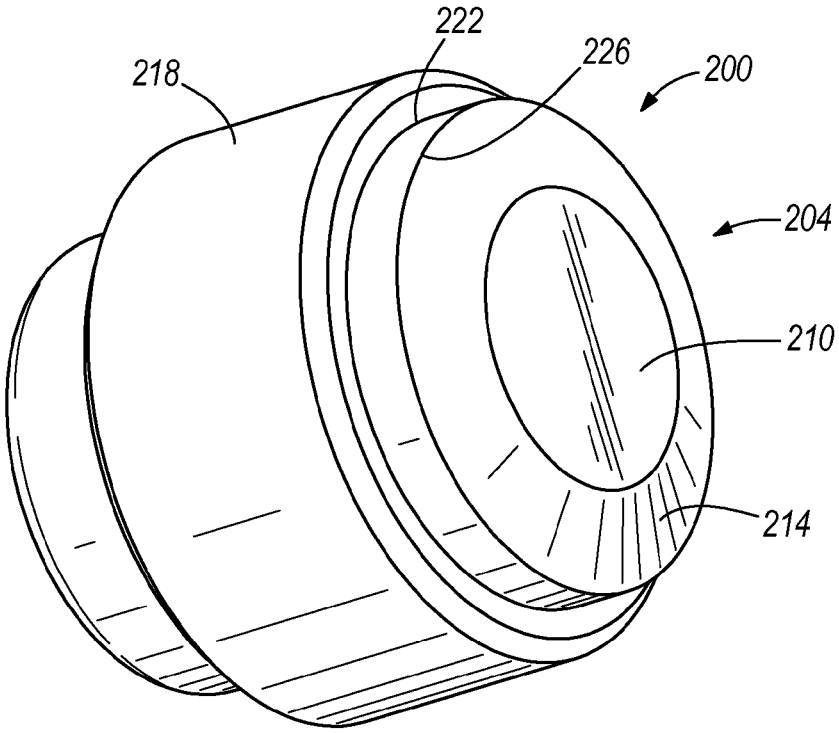
FIG. 6 is a front perspective view of the retaining pin of FIG. 5.
Figure 7:
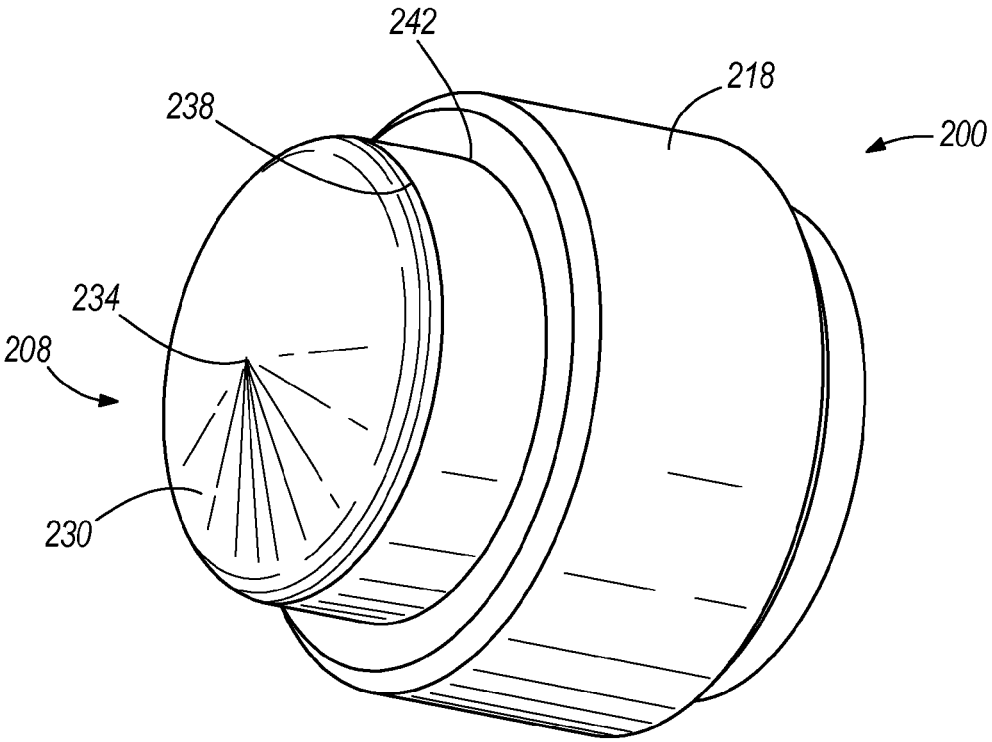
FIG. 7 is a rear perspective view of the retaining pin of FIG. 5.

Referring to FIGS. 5-7, the retaining pin 200 has a proximal end 204 and a distal end 208. The proximal end 204 is adjacent to the tube chamber 178 when the retaining pin 200 is disposed within the aperture 154. The proximal end 204 presents a substantially flat engagement face 210 for engagement with the focusing tube 142, as will be further explained below. A front tapered surface 214 extends distally from the engagement face 210. The body 218 of the retaining pin 200 has an outer diameter "D" and forms a front step 222 with the distal edge 226 of the front tapered surface 214. A concentric rear tapered surface 230 extends proximally from a central point 234. An edge 238 forms a rear step 242 with the body 218. As illustrated, the retaining pin 200 is axially symmetric for assembly within the aperture 154.

Referring to FIGS. 2, 3, and 4*a*, a retaining member, such as a nut 300 includes a tube opening 304 through which the focusing tube 142 passes. Female threads 308 are engageable with the male threads 158 of the shaft 134 in a conventional manner to convert rotational force applied to the retaining nut 300 to a resultant vertical translation. Due to the vertical translation of the retaining nut 300, a tapered surface 312 engages the retaining pin 200 to secure the focusing tube 142 within the tube chamber 178, as will be further described below.

The aforementioned cutting head body 100 and associated components, the retaining pin 200, and the retaining nut 300 are all primarily made of metal. In some constructions, the retaining pin 200 can also be made of plastic or ceramic. Other materials and methods of manufacture do not limit the cutting head 40 as presently described.

Referring again to FIG. 4*a*, during the cutting process, the orifice mount 114 converts high pressure water within the high pressure fluid chamber 162 to a high velocity fluid stream that passes through the mixing chamber 166 of the mixing chamber housing 118. Abrasive particles entering through the abrasive port 130 are entrained into the fluid stream in the mixing chamber 166 to form an abrasive cutting mixture. The high velocity mixture passes through the funnel 184 of the focusing tube 142, which facilitates a smooth fluid entry into the stream channel 186. The abrasive stream is uniformly conveyed within the stream channel 186 and exits through the discharge opening 188 onto the material surface. The o-ring 190 provides a barrier between any seepage of the cutting mixture that passes through the contact interface 180 and the retaining pin 200. In addition, the o-ring 190 serves to hold the focusing tube 142 in place when the nut 300 is loosened so that the focusing tube 142 does not simply fall out.

Figure 4B:
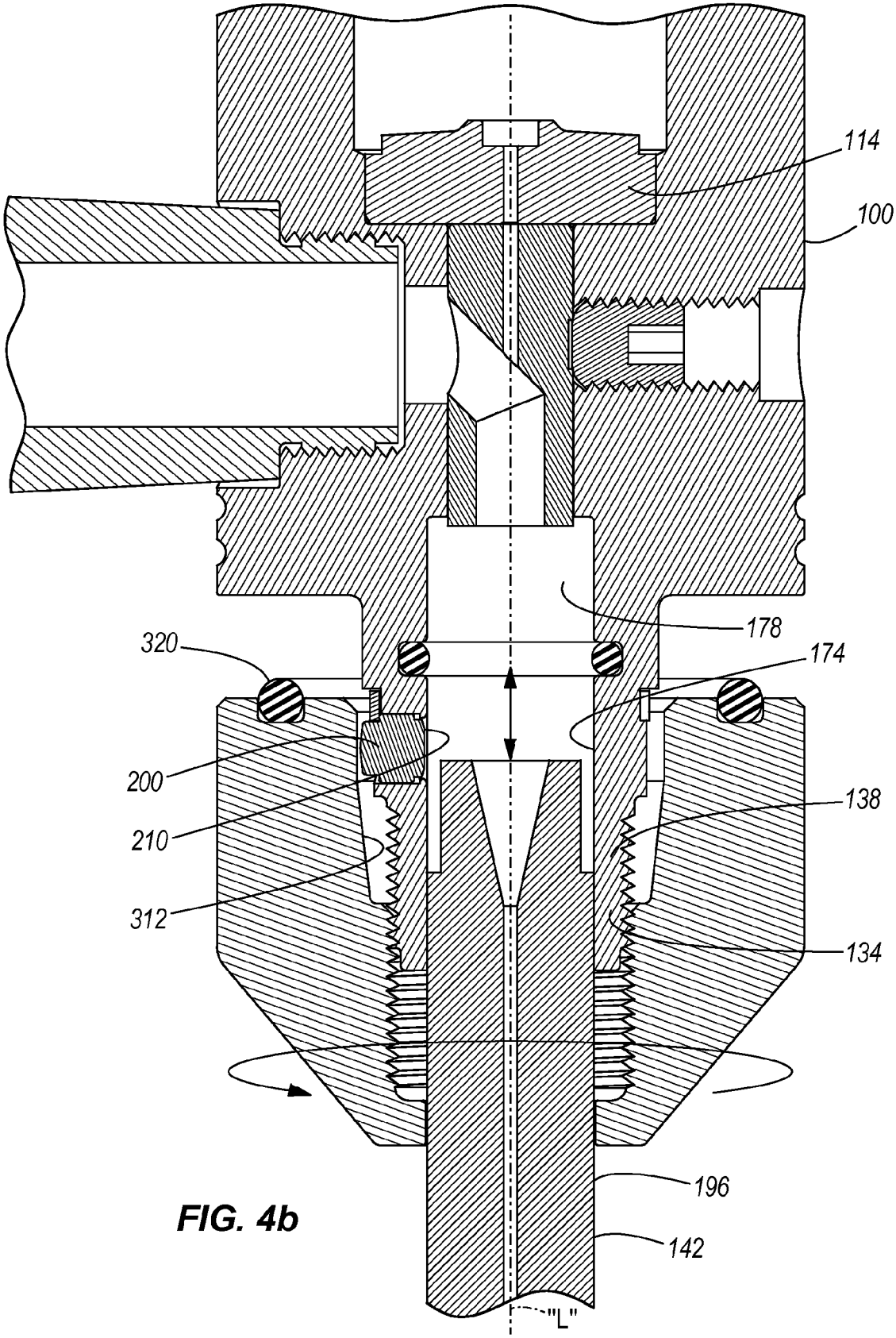
FIG. 4*b* is a section view taken generally along line 4-4 of FIG. 2 with the retaining nut partially threaded onto the cutting head shaft.

In operation, referring to FIGS. 4*a*, 4*b*, and 5, the focusing tube 142 is first inserted into the empty tube chamber 178. If a portion of the retaining pin 200 is disposed within the tube chamber 178, upon initial contact of the focusing tube 142 with the front tapered surface 214 of the retaining pin 200, the retaining pin 200 slightly retracts into the aperture 154 to a first position (see FIGS. 4*b* and 5). Once the focusing tube 142 is inserted, the retaining nut 300 is rotated to thread it onto the shaft 134. Concurrently with the threading motion, the tapered surface 312 engages the rear tapered surface 230 of the retaining pin 200 and, as the retaining nut 300 progresses toward the cutting head body 100, the tapered surface 312 urges or biases the retaining pin 200 laterally within the aperture 154 toward the inserted focusing tube 142. As the retaining pin 200 advances within the aperture 154, the engagement face 210 contacts and presses against the exterior surface 196 of the focusing tube 142, clamping the tube 142 against the portion of the inner wall surface 174 of the annular wall 138 that is opposite to the engagement face 210, while aligning the tube 142 along the common axis "L." The friction developed between the tapered surface 312 and the rear tapered surface 230 renders the retaining nut 300 self locking such that the focusing tube 142 is sufficiently secured within the cutting head body 100. When the retaining nut 300 is threaded onto the shaft 134 the desired amount, the fluid stream exiting the orifice mount 114 is collinear with the focusing tube 142, and more specifically with the stream channel 186, and the retaining pin 200 is in a second position in which a portion of the pin 200 is disposed within the tube chamber 178. It is important that the stream channel 186 of the focusing tube 142 be properly aligned with the high velocity fluid stream exiting the orifice mount 114 to avoid premature wear of the focusing tube from, for example, excessive impingement by the fluid stream on the sides of the channel 186. An o-ring 320 sealingly engages the retaining nut 300 with the cutting head 100 to preclude the entrance of outside contaminants.

To release and extract the focusing tube 142, the retaining nut 300 is rotated in the opposite direction, which disengages the surface 312 from the rear tapered surface 230 of the retaining pin 200, lessening the contact force between the engagement face 210 and the outside surface 196. The focusing tube 142 can then be grasped and removed from the tube chamber 178 and replaced as previously discussed.

In an alternative embodiment, the direction of rotation of the nut 300 could be reversed such that the rear tapered surface 230 of the retaining pin 200 is engaged by downward motion of the nut 300 away from the cutting head body 100, and disengaged by motion of the nut 300 toward the cutting head body 100.

As further shown in FIG. 5, when the tube chamber 178 is empty (with no focusing tube 142), the front step 222 of the retaining pin 200 cooperates with the circumferential step 198, or first retaining portion, to limit inward motion of the retaining pin 200 toward the tube chamber 178. Specifically, the diameter "d" of the step 198 is smaller than the diameter "D" of the retaining pin body 218 and therefore the step 198 inhibits the retaining pin 200 from falling into the tube chamber 178. Contact between the inner surface 152 of the hoop ring 150, or second retaining portion, and the rear step 242 of the retaining pin 200 limits outward motion and therefore inadvertent withdrawal of the retaining pin 200 from the aperture 154. Both the circumferential step 198 and the inner surface 152 define an operational travel range within which the retaining pin 200 can translate freely without interference to clamp and release the focusing tube 142.

Various features and advantages of the invention are set forth in the following claims.

We claim:

1. A cutting head for a high pressure water jet cutting assembly, the cutting head comprising:

a body including an inner chamber, a first aperture, and a second aperture, each of the first aperture and the second aperture extending into the inner chamber; a focusing tube removably insertable within the inner chamber along a longitudinal axis via the first aperture;

an engagement member at least partially disposed within the aperture and movable with respect to the focusing tube between a first position and a second position in which a portion of the engagement member is disposed within the inner chamber; and a retaining member engageable with the body and movable with respect to the body to bias the engagement member toward the second position and into direct engagement with the focusing tube to retain the focusing tube within the inner chamber and to align the focusing tube substantially along the longitudinal axis.

2. The cutting head of claim 1, wherein the inner chamber is defined by a substantially cylindrical wall.

3. The cutting head of claim 1, wherein the focusing tube has a substantially cylindrical exterior surface and a substantially cylindrical bore, the cylindrical bore having a center line that is substantially coincident with the longitudinal axis when the focusing tube is aligned.

4. The cutting head of claim 1, wherein the engagement member is a pin.

5. The cutting head of claim 4, wherein the pin includes a substantially flat face configured for engagement with the focusing tube.

6. The cutting head of claim 1, wherein the body includes a first retaining portion and a second retaining portion that define an operational travel range for the engagement member, and further wherein the first retaining portion and the second retaining portion inhibit movement of the engagement member without the range.

7. The cutting head of claim 6, wherein the first retaining portion is integrally formed as one piece with the body.

8. The cutting head of claim 6, wherein the second retaining portion includes a ring formed separate from the body and fixedly attached to the body.

9. The cutting head of claim 1, wherein the retaining member threadably engages the body.

10. The cutting head of claim 1, wherein the retaining member includes a conical surface that engages the engagement member and biases the engagement member to the second position as the retaining member moves toward the body.

11. A cutting head for a high pressure water jet cutting assembly, the cutting head comprising:

a body including a tube portion that extends along an axis, the tube portion defining an inner chamber, a first threaded portion, and an aperture that extends through the tube portion in a direction substantially normal to the axis;

an engagement member at least partially disposed within the aperture and movable between a first position and a second position in which a portion of the engagement member is disposed within the inner chamber;

a focusing tube removably insertable into the inner chamber; and a retaining member having a second threaded portion that threadably engages the first threaded portion, wherein movement of the retaining member toward the body biases the engagement member into direct contact with the focusing tube to retain the focusing tube within the inner chamber and to align the focusing tube substantially along the axis.

12. The cutting head of claim 11, wherein the engagement member includes a substantially flat face configured for engagement with the focusing tube.

13. The cutting head of claim 11, wherein the body includes a first retaining portion and a second retaining portion that define an operational travel range for the engagement member, and further wherein the first retaining portion and the second retaining portion inhibit movement of the engagement member without the range.

14. The cutting head of claim 13, wherein the first retaining portion is integrally formed as one piece with the body and wherein the second retaining portion includes a ring formed separate from the body and fixedly attached to the body.

15. The cutting head of claim 11, wherein the retaining member includes a tapered surface that engages the engagement member and biases the engagement member toward the second position during the movement of the retaining member toward the body.

16. An assembly for retaining and aligning a focusing tube, the assembly comprising: a shaft of a cutting head of a high pressure water jet cutting assembly, the shaft having a shaft wall defining an inner chamber open to receive the focusing tube along a longitudinal axis and an aperture formed through the wall in communication with the inner chamber, an engagement member having a proximal end adjacent the inner chamber upon insertion into the aperture, and a distal end, the engagement member further including a substantially flat face at the proximal end; and a tapered surface at the distal end;

a retaining member couplable with the shaft, the retaining member including an internally tapered surface, wherein coupling the retaining member to the shaft engages the internally tapered surface with the tapered surface of the engagement member to advance the substantially flat face toward the focusing tube to retain the focusing tube within the inner chamber and to align the focusing tube substantially along the longitudinal axis; and a ring seated around the shaft, the ring having an inner surface, and wherein the engagement member includes a distal stepped surface engageable with the inner surface of the ring to limit movement of the engagement member.

17. The assembly of claim 16, wherein the tapered surface at the distal end of the engagement member is a first tapered surface, and wherein the engagement member further includes a second tapered surface at the proximal end extending distally from the substantially flat face.

18. The assembly of claim 16, wherein the aperture has an integrally formed step, and further wherein the engagement member includes a proximal stepped surface adjacent the flat face, the proximal stepped surface cooperable with the integrally formed step to limit movement of the engagement member.

19. The assembly of claim 16, wherein the retaining member is threadably couplable with the shaft.

* * * * *